US006092294A

United States Patent [19]

Mak

[11] Patent Number: 6,092,294

[45] Date of Patent: Jul. 25, 2000

[54] DRAWING BOARD

[75] Inventor: Kai-Shun Mak, Kwai Chung, The Hong Kong Special Administrative Region of the People's Republic of China

[73] Assignee: Hop Lee Cheong Industrial Company Limited, The Hong Kong Special Administrative Region of the People's Republic of China

[21] Appl. No.: 09/115,205

[22] Filed: Jul. 14, 1998

[51] Int. Cl.[7] ..... B43L 13/00; A63H 33/26

[52] U.S. Cl. ..... 33/18.1; 33/18.2; 446/131

[58] Field of Search ..... 33/18.1, 18.2, 33/21.1; 446/131, 129

[56] References Cited

U.S. PATENT DOCUMENTS

| | | | |
|---|---|---|---|
| 3,426,453 | 2/1969 | Dingwall et al. | 446/131 |
| 4,124,951 | 11/1978 | Wallch | 446/131 |
| 4,540,375 | 9/1985 | Fogarty et al. | 446/131 |
| 4,674,433 | 6/1987 | Inada | 116/279 |
| 4,801,266 | 1/1989 | Kinberg | 33/18.1 |
| 4,976,647 | 12/1990 | Axtell | 446/131 |
| 5,571,322 | 11/1996 | Yao et al. | 33/18.1 |

*Primary Examiner*—Christopher W. Fulton
*Assistant Examiner*—Quyen Doan
*Attorney, Agent, or Firm*—Samuels, Gauthier & Stevens

[57] ABSTRACT

A drawing board having a body and a generally transparent screen on the body. The screen has front and rear sides and contains a viscous opaque liquid and iron dust in the liquid. A magnetic eraser is movable within the body between a rest position away from the rear side of the screen and an operating position against that rear side for operation to move, through magnetic attraction, the iron dust away from the front side of the screen such that the iron dust becomes invisible on the screen. A spring biasses the eraser towards the rest position. A pen having a magnetic tip is used to draw on the screen.

8 Claims, 2 Drawing Sheets

DRAWING BOARD

SUMMARY OF THE INVENTION

According to the invention, there is provided a drawing board comprising a body, a generally transparent screen on the body, said screen having front and rear sides and containing a viscous opaque liquid and iron particles in the liquid, a magnetic eraser movable within the body between a rest position away from the rear side of the screen and an operating position against that rear side for operation to move, through magnetic attraction, the iron particles away from the front side of the screen such that the iron particles become invisible on the screen, and a spring arranged to resiliently bias the eraser towards the rest position.

Preferably, the eraser has a size sufficient to cover the entire screen from behind.

The drawing board may include a plurality of said springs which are provided on at least two opposite lateral sides of the eraser.

In a preferred embodiment, the spring is in the form of a leaf spring.

More preferably, the eraser has a body on which the spring is supported.

Further more preferably, the eraser body is made of plastic and the spring is integrally formed with the eraser body.

In a preferred embodiment, the drawing board includes a plurality of said springs which are arranged to act at regular positions with respect to the eraser.

More preferably, the eraser is substantially rectangular and the springs are arranged to act at positions corresponding to the four corners of the eraser.

The drawing board may include an instrument having a magnetic part for use on the screen.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
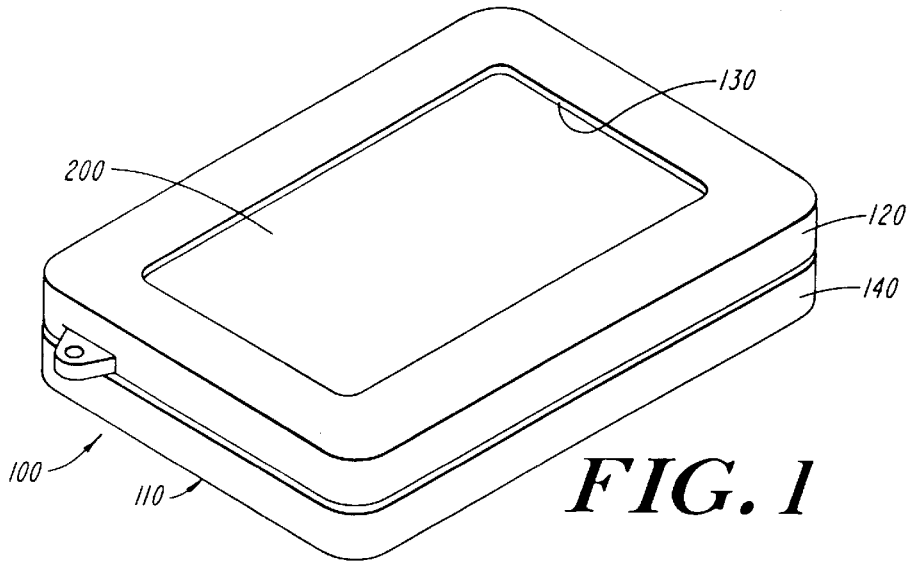
FIG. 1 is a top perspective view of an embodiment of a drawing board in accordance with the invention.
Figure 2:
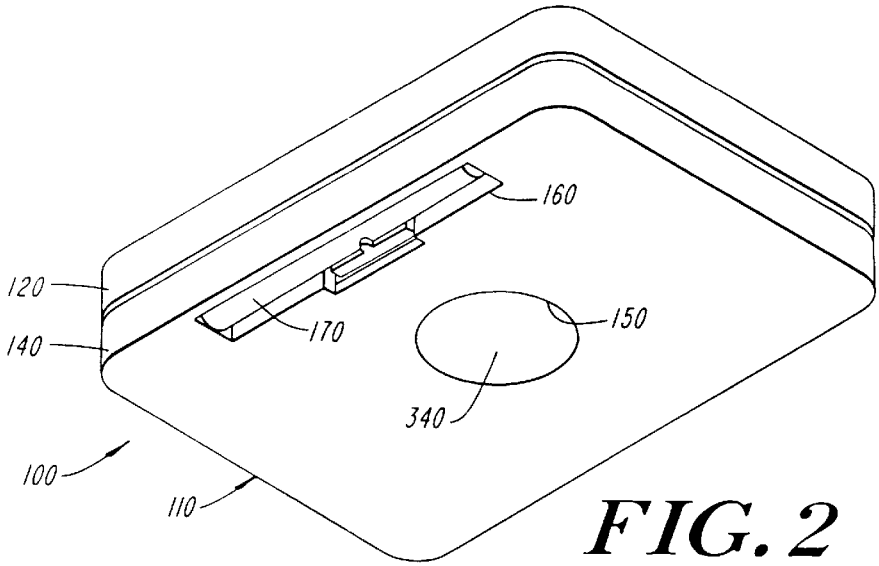
FIG. 2 is a bottom perspective view of the drawing board of FIG. 1.
Figure 4:
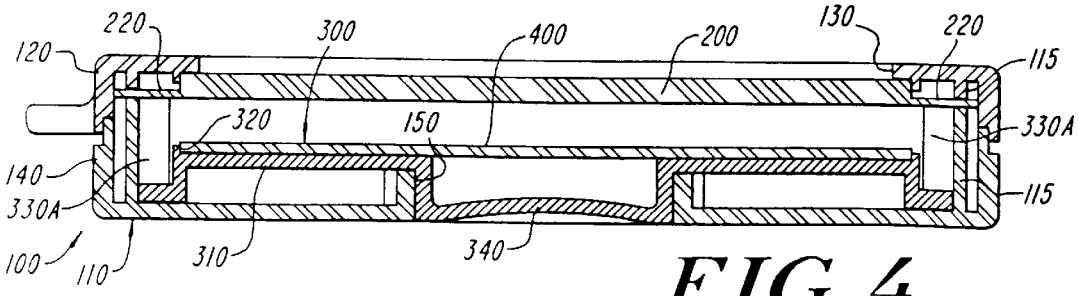
FIG. 4 is a cross-sectional side view of the drawing board of FIG. 1.
Figure 3:
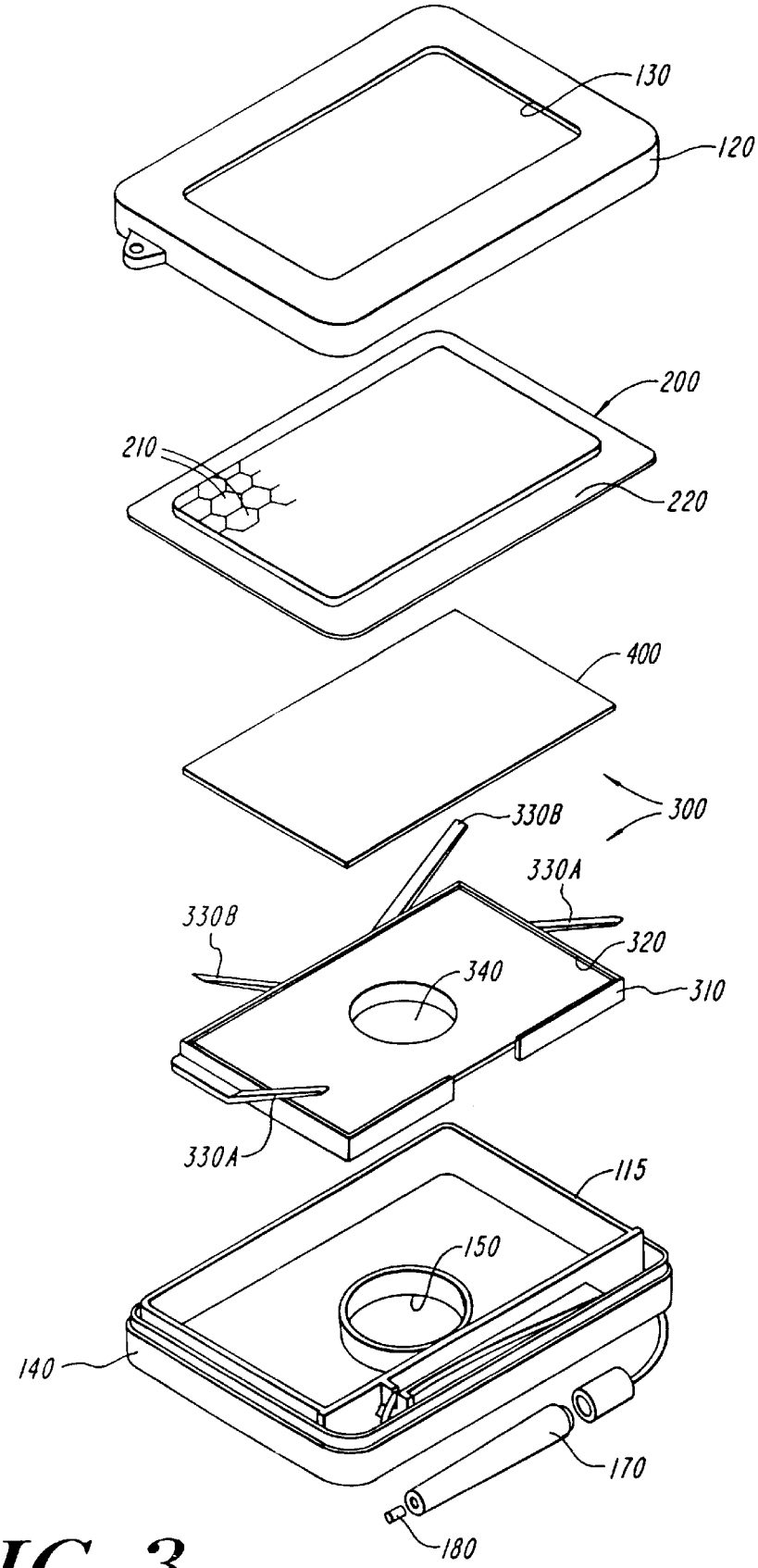
FIG. 3 is an exploded top perspective view of the drawing board of FIG. 1.

Referring to the drawings, there is shown a drawing board 100 embodying the invention, which drawing board 100 has a flat rectangular hollow body 110 formed by a top part 120 having a large rectangular aperture 130 and a bottom part 140 having a central circular hole 150 and an oblong side recess 160. The aperture 130 is fully covered, from behind, by a rectangular screen 200 made of a generally transparent plastic material. The screen 200 has an internal honeycomb structure to define numerous small hexagonal sealed cells 210. Each cell 210 is fully prefilled with a viscous opaque white liquid containing or impregnated with a small amount of iron particles or dust. The viscosity of the liquid is such that the iron dust is suspended and stays at generally the same place in the liquid and will be moved to a different place if attracted by a magnet. A pen 170, having a magnetic tip 180, is releasably held within the recess 160.

The drawing board 100 incorporates an internal eraser 300 provided behind the screen 200. The eraser 300 is formed by a plastic body 310 and a magnet 400, both being flat rectangular. The eraser body 310 has, on its top side, a shallow recess 320 within which the magnet 400 is located by glue such that the top side of the magnet 400 protrudes slightly out of the recess 320. The magnet 400 has a size across slightly larger than the aperture 130 (the exposed area or effective size of the screen 200) and extends parallel to the screen 200. The screen 200 has relatively thinner edge portions 220 extending slightly beyond the aperture 130.

The eraser body 310 is formed with an integral strip 330A on each of the shorter sides and a pair of integral strips 330B on one of the longer sides. The strips 330A and 330B are inclined at an acute angle upwards from the plane of the eraser body 310, for acting as leaf springs. The two strips 330A point away from the pair of strips 330B, which in turn point away from each other. When viewed from above, the strips 330A and 330B extend along respective sides of the eraser body 310 to reach, particularly in a compressed condition, regular positions corresponding to the four corners of the eraser body 310. A central flat cylindrical button 340 is integrally formed on the bottom side of the eraser body 310.

For assembly, the screen 200 is placed within the top body part 120 to cover the aperture 130, and the eraser 300 is placed within the bottom body part 140 to have the button 340 extending into the hole 150. The two body parts 120 and 140 are then closed and secured together, such as by glue. The screen 200 is clamped in position, by its edge portions 220, between internal peripheral ribs 115 of the body parts 120 and 140.

The eraser 300 is movable between a rest position away from the rear side of the screen 200 and an operating position against that rear side. The strips 330A and 330B are partially compressed to bear against the edge portions 220 on the rear side of the screen 200, whereby the overall eraser 300 is resiliently biassed towards the rest position with the button 340 outwards. More specifically, the free ends of the strips 330A and 330B act against near the four corners of the screen 200, and this ensures an even and/or balanced biassing force acting upon the eraser 300.

In use, the pen 170 is moved with its the tip 180 across the screen 200. The tip 180, by reason of being magnetic, will attract the iron dust within the relevant cells 210 to come close to the front side of the screen 200 and thus become visible through the front side. A line is drawn on the screen 200, which is formed by the then visible iron dust. Pressing of the bottom button 340 will move the internal magnet 400 against the rear side of the screen 200, counter-acting the action of the spring strips 330A and 330B. As a result, the visible iron dust will be removed by the magnet 400, through magnetic attraction, from the screen's front side and thus become invisible or erased. Upon release of the button 340, the screen 200 is ready for drawing again. A simple and convenient pressing action clears the screen 200.

It is envisaged that any other (drawing) instruments having a magnetic part may be used on the screen 200, such as a stamp having a magnetic surface of a specific design for creating a drawing of the same design.

The invention has been given by way of example only, and various other modifications of and/or alterations to the described embodiment may be made by persons skilled in the art without departing from the scope of the invention as specified in the appended claims.

What is claimed is:

1. A drawing board comprising a body, a generally transparent screen on the body, said screen having front and rear sides and containing a viscous opaque liquid and iron particles in the liquid, a magnetic eraser movable within the body between a rest position away from the rear side of the screen and an operating position against that rear side for operation to move, through magnetic attraction, the iron particles away from the front side of the screen such that the iron particles become invisible on the screen, and a plurality of said springs which are provided on at least two opposite lateral sides of the eraser to resiliently bias the eraser towards the rest position.

2. A drawing board comprising a body, a generally transparent screen on the body, said screen having front and rear sides and containing a viscous opaque liquid and iron particles in the liquid, a magnetic eraser movable within the body between a rest position away from the rear side of the screen and an operating position against that rear side for operation to move, through magnetic attraction, the iron particles away from the front side of the screen such that the iron particles become invisible on the screen, and a plurality of said springs which are arranged to act at regular positions with respect to the eraser to resiliently bias the eraser towards the rest position.

3. A drawing board as claimed in claim 1, wherein the eraser has a size sufficient to cover the entire screen from behind.

4. A drawing board as claimed in claim 2, wherein the spring is in the form of a leaf spring.

5. A drawing board as claimed in claim 4, wherein the eraser has a body on which the spring is supported.

6. A drawing board as claimed in claim 5, wherein the eraser body is made of plastic and the spring is integrally formed with the eraser body.

7. A drawing board as claimed in claim 1 and 2, including an instrument having a magnetic part for use on the screen.

8. A drawing board as claimed in claim 1 or 2, wherein the eraser is substantially rectangular and the springs are arranged to act at positions corresponding to the four corners of the eraser.

* * * * *